US008407863B2

(12) United States Patent
Cheng

(10) Patent No.: US 8,407,863 B2
(45) Date of Patent: Apr. 2, 2013

(54) CABLE TIE STRUCTURE

(75) Inventor: Juei-Ching Cheng, Xianxi Township, Changhua County (TW)

(73) Assignee: K.S. Terminals Inc., Changhua County (TW)

( * ) Notice: Subject to any disclaimer, the term of this patent is extended or adjusted under 35 U.S.C. 154(b) by 56 days.

(21) Appl. No.: 12/882,367

(22) Filed: Sep. 15, 2010

(65) Prior Publication Data

US 2012/0047691 A1 Mar. 1, 2012

(30) Foreign Application Priority Data

Aug. 30, 2010 (TW) ..... 99129069 A

(51) Int. Cl.
*B65D 63/00* (2006.01)

(52) U.S. Cl. ..... 24/16 PB

(58) Field of Classification Search ..... 24/16 R, 24/16 PB; 248/74.3
See application file for complete search history.

(56) References Cited

U.S. PATENT DOCUMENTS 3,537,146 A * 11/1970 Caveney ..... 24/16 PB
3,590,442 A * 7/1971 Geisinger ..... 24/16 PB
3,605,199 A * 9/1971 Eberhardt ..... 24/16 PB
3,660,869 A * 5/1972 Caveney et al. ..... 24/16 PB
3,735,448 A * 5/1973 Waddington ..... 24/16 PB
3,872,547 A * 3/1975 Caveney et al. ..... 24/16 PB
3,887,965 A * 6/1975 Schuplin ..... 24/16 PB
3,906,593 A * 9/1975 Caveney et al. ..... 24/16 PB
3,908,233 A * 9/1975 Caveney et al. ..... 24/16 PB
3,924,299 A * 12/1975 McCormick ..... 24/16 PB
3,965,538 A * 6/1976 Caveney et al. ..... 24/16 PB
3,967,345 A * 7/1976 Sumimoto ..... 24/16 PB
4,009,509 A * 3/1977 McCormick ..... 24/16 PB
4,021,888 A * 5/1977 Aimar ..... 24/16 PB
4,272,870 A * 6/1981 McCormick ..... 24/16 PB
4,688,302 A * 8/1987 Caveney et al. ..... 24/16 PB
6,807,714 B2 * 10/2004 O'Young et al. ..... 24/16 PB
2006/0162130 A1 * 7/2006 Cook ..... 24/16 PB

* cited by examiner

*Primary Examiner* — Robert J Sandy
*Assistant Examiner* — David Upchurch
(74) *Attorney, Agent, or Firm* — Ming Chow; Sinorica, LLC

(57) ABSTRACT

An improved cable tie structure includes a locking head and a strap body. The strap body includes a first end and a second end. The locking head includes a window formed on a base plate, first side walls, a second side wall, first protrusions, second protrusions and a tooth unit. The first protrusions are formed at lateral sides of the window. Two lateral sides of the second side wall are attached to the first side walls. Each of the first protrusions is disposed at the side corresponding to the position where each of first side walls faces the window. The tooth unit has first engaging teeth. The strap body has second engaging teeth for engaging the first engaging teeth. The second protrusions extend above the window from two lateral sides of the tooth unit. A slit is formed between each facing pair of the first protrusion and the second protrusion.

8 Claims, 5 Drawing Sheets

CABLE TIE STRUCTURE

BACKGROUND OF THE INVENTION

1. Technical Field

The present invention relates to cable ties, and more particularly to a mounting cable tie used for binding and tying.

2. Description of Related Art

Cable ties commercially available nowadays include mainly mounting cable ties and releasable cable ties, both of which have a head and a strap body structured to engage each other, so that the strap body of the cable tie, after holding an article to be bound, can be inserted into and in turn get retained by the head of the cable tie, thereby binding, tying up and fixing the article for storage or other purposes.

Therein, a releasable cable tie features releasable engagement between its strap body and its head that allows its reuse. Such a releasable cable tie is generally employed for simple storage of an article to be bound, such as a coiled power cord.

On the other hand, a mounting cable tie has its strap body being unable to be withdrawn from its head after single engagement, so is limited to a one-time use. In its usage, once the strap body of the cable tie engages with the head, any further pull acted on the strap body of the cable tie can only constrict it more and its binding force cannot be dismissed unless it is cut off or broken. Thus, such a mounting cable tie is generally used for particular occasions where a one-time use is desired in order to make an article bound tightly by the mounting cable tie without possibility of release, and can be easily seen in retail stores binding a given amount of products for sale. The mounting cable ties are even used as temporary handcuffs in some countries.

Hence, mounting cable ties are desired to have strong structure and high pull-out resistance, for avoiding a counterforce from the article bound thereby to break or loosen the engaging structures of the strap body and the head.

SUMMARY OF THE INVENTION

For remedying the imperfectness of the prior-art devices, the present invention proposes an improved cable tie structure, which includes a locking head and a strap body. Therein, a direction from the strap body toward the locking head is a first direction, and a direction perpendicular to the first direction is a second direction. The locking head is formed with a window. A direction going upward from the window and being perpendicular to both the first direction and the second direction is a third direction. The strap body has a first end and a second end, wherein the first end is attached to the locking head and the second end passes through the window to engage with the locking head.

The locking head has a base plate, a pair of first side walls, a second side wall, a pair of first protrusions, a pair of second protrusions and a tooth unit. The window is formed on the base plate. The base plate has a front end and a rear end. The pair of first side walls defining two opposite borders of the window in the second direction. The second side wall is formed at one end of the locking head along the first direction while being far from the strap body. The both lateral sides of the second side wall are respectively attached to each of said first side walls. Each of the first protrusions is disposed at the side corresponding to the position where each of first side walls faces the window. The tooth unit has a base, by which the tooth unit is attached to the base plate. The tooth unit extends above the window from the base plate and is located between the pair of first protrusions, such that the tooth unit is allowed to swing to and fro along the first direction against its base. A surface of the tooth unit facing the second side wall is a first surface, and a surface of the tooth unit far from the second side wall is a second surface. The first surface has a plurality of first engaging teeth. The pair of second protrusions extend above the window from the both lateral sides of the tooth unit. In addition, a predetermined slit extending along the first direction exists between each facing pair of the first protrusion and the second protrusion. The strap body has a top surface and a bottom surface. The bottom surface has a plurality of second engaging teeth, which is able to engage with the plurality of first engaging teeth of the tooth unit. The strap body has a thickness greater than a distance from tops of the first engaging teeth of the tooth unit to the second side wall.

Therefore, the primary objective of the present invention is to provide the aforementioned improved cable tie structure, wherein for using the improved cable tie structure, after the strap body pierces through the window of the locking head along the third direction, the second engaging teeth of the strap body push the first engaging teeth of the tooth unit counter to the first direction, so that the tooth unit swings against its base toward the rear end of the base plate. Since a depth of the first engaging teeth is greater than that of the second engaging teeth, when engaging mutually, the first engaging teeth and the second engaging teeth jointly form therebetween a small interval. As compared with the prior art, the strap body is enabled to enter the window along the third direction easily with reduced resistance.

Another objective of the present invention is to provide the aforementioned improved cable tie structure, wherein when the strap body enters the window of the locking head along the third direction, if the strap body is forced to disengage counter to the third direction, since the second engaging teeth of the strap body engage the first engaging teeth of the tooth unit, the strap body pulls the tooth unit along the first direction, and since the predetermined slits formed between the facing first protrusions and second protrusions along the first direction allow the tooth unit to slightly swing along the first direction, the slight swing makes the first engaging teeth of the tooth unit snap at the second engaging teeth of the strap body more closely. Finally the second protrusions abut firmly against the first protrusions to restrict the tooth unit from further swing. In addition, the first engaging teeth engage the second engaging teeth firmly, so that the strap body is retained from being withdrawn from the locking head, thereby enhancing the pull-out resistance of the cable tie.

Another objective of the present invention is to provide the aforementioned improved cable tie structure, wherein the locking head has the window, the first side walls and the second side wall. A guiding surface is formed on the second side wall of the locking head for facing the window in order to guide the strap body to pass through the window. Thereby, a user can easily make the strap body pierce through the window of the locking head, so as to tie up an article to be bound readily.

BRIEF DESCRIPTION OF THE DRAWINGS

The invention as well as a preferred mode of use, further objectives and advantages thereof will be best understood by reference to the following detailed description of an illustrative embodiment when read in conjunction with the accompanying drawings, wherein.

DETAILED DESCRIPTION OF THE INVENTION

While the present invention discloses an improved cable tie structure, the engaging teeth and the principles on which the engaging teeth engage mutually for fixation have been known to people of ordinary skill in the art and need not to be discussed in any length in the following description. Also, the accompanying drawings referred by the following description are intended to show the characteristics of the present invention and are not necessarily made to scale.

Figure 1:
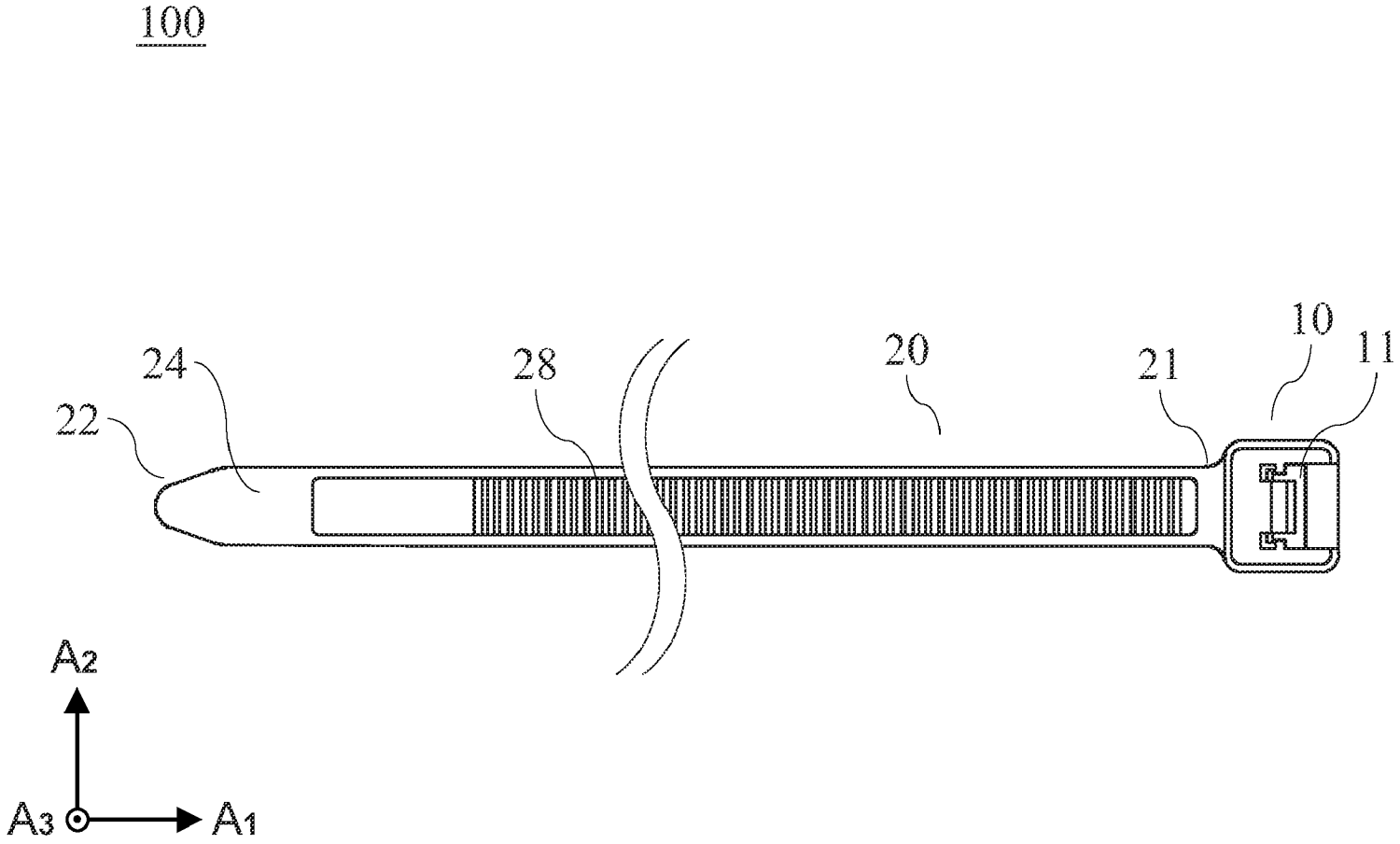
FIG. 1 is a schematic drawing of an improved cable tie structure according to a preferred embodiment of the present invention.

Please refer to FIG. 1 for a preferred embodiment of the present invention. Therein, an improved cable tie structure 100 depicted including a locking head 10 and a strap body 20. A direction from the strap body 20 toward the locking head 10 is a first direction A1, and a direction perpendicular to the first direction A1 is a second direction A2. The locking head 10 is formed with a window 11. Upward from the window 11 and perpendicular to the first direction A1 and the second direction A2, it is a third direction A3. The strap body 20 has a first end 21 and a second end 22 in the first direction A1. The first end 21 is attached to the locking head 10 and the second end 22 is configured to pass through the window 11 of the locking head 10 along the third direction A3 for mutual engagement with the locking head 10, thereby binding an article to be tied up.

Figure 2:
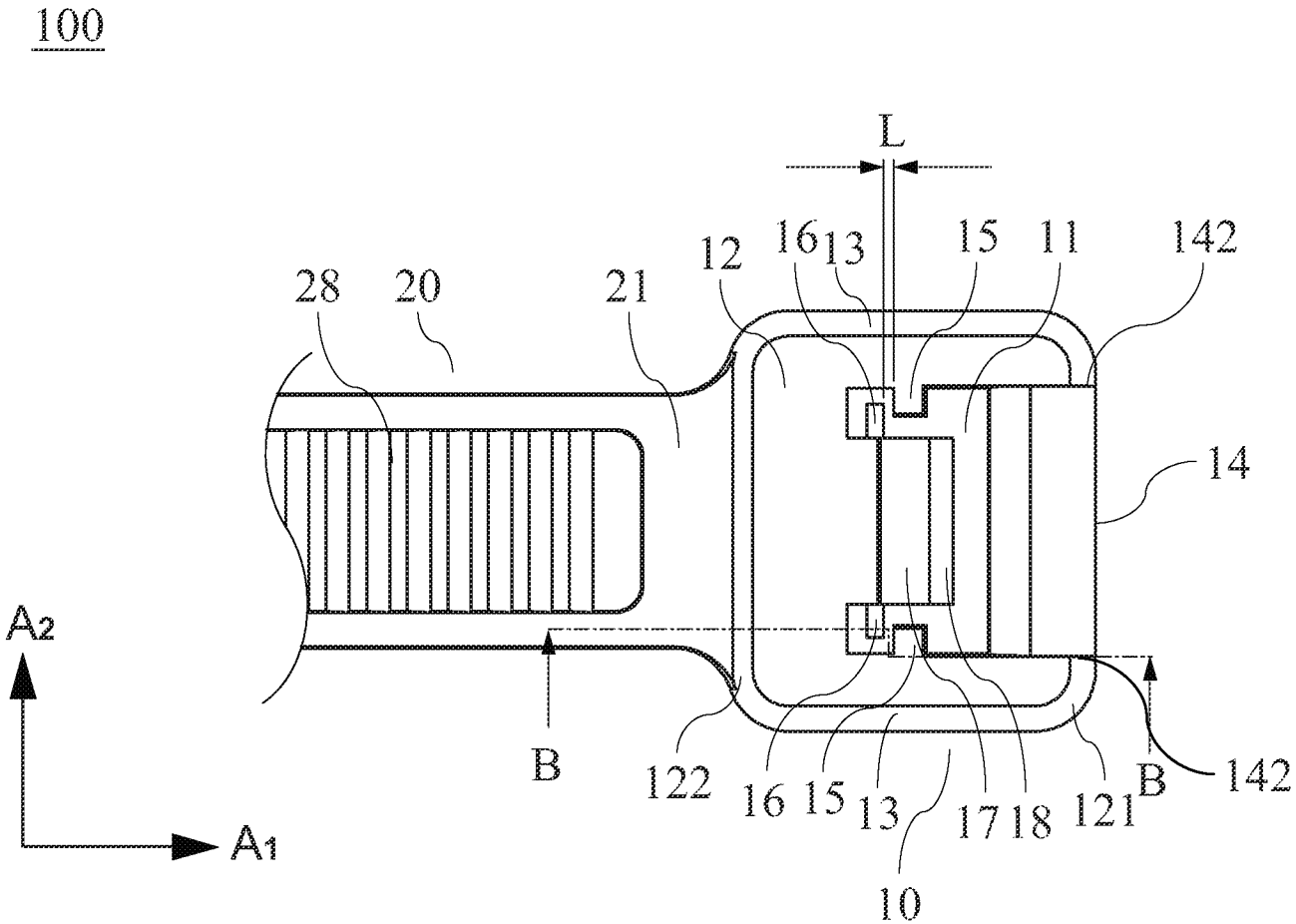
FIG. 2 is a partial top view of the improved cable tie structure according to the preferred embodiment of the present invention.
Figure 3:
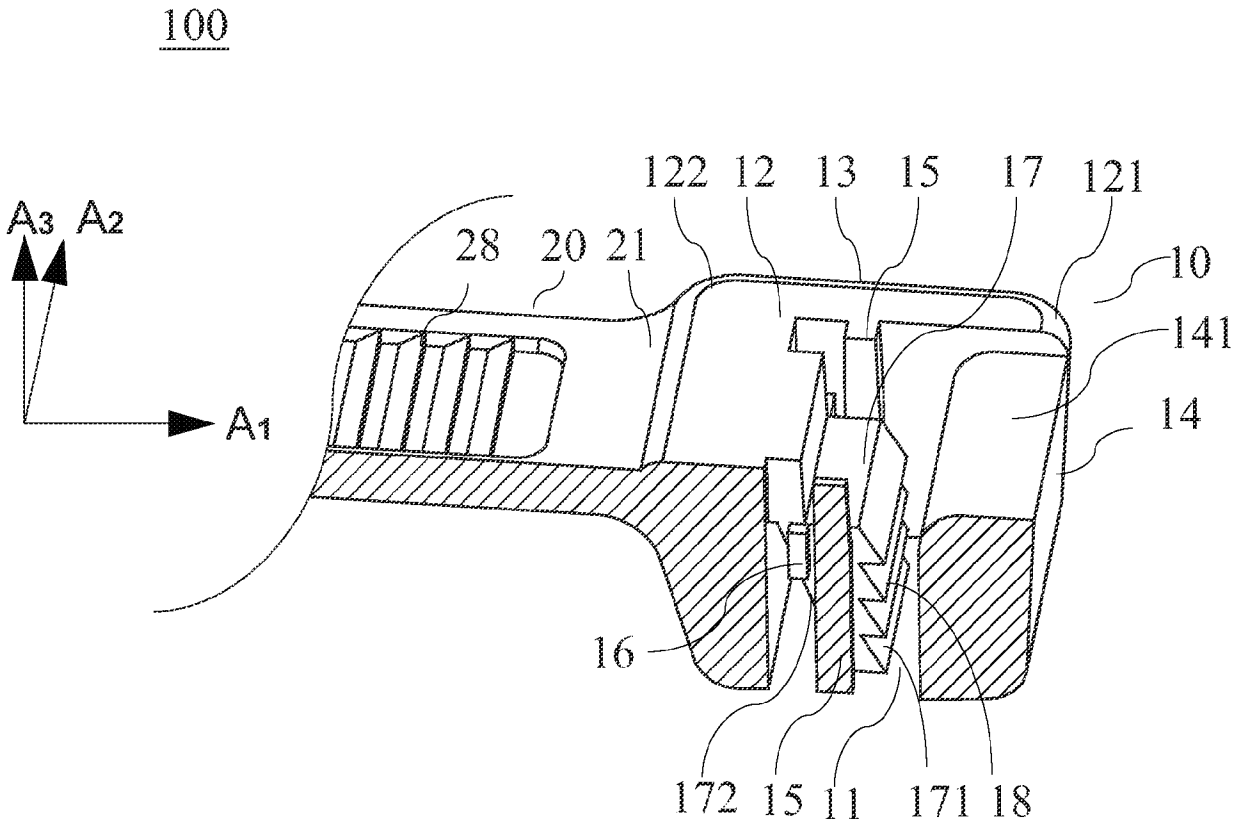
FIG. 3 is a perspective view of the improved cable tie structure of FIG. 2 sectioned along Line B-B.

FIG. 2 is a partial top view of the improved cable tie structure 100 and FIG. 3 is made based on a sectional line B-B shown in FIG. 2. According to the drawings, the locking head 10 of the improved cable tie structure 100 has a base plate 12, a pair of first side walls 13, a second side wall 14, a pair of first protrusions 15, a pair of second protrusions 16 and a tooth unit 17. The base plate 12 has a front end 121 and a rear end 122 opposite in the first direction A1. The first end 21 of the strap body 20 is attached to the rear end 122 of the base plate 12. The window 11 is formed on the base plate 12. The first side walls 13 define two opposite borders of the window 11 in the second direction A2. The second side wall 14 defines a border of the window 11 of the locking head 10 in the first direction A1 and is away from the strap body 20. The second side wall 14 with two lateral sides 142 thereof attached to the respective first side walls 13.

Figure 4:
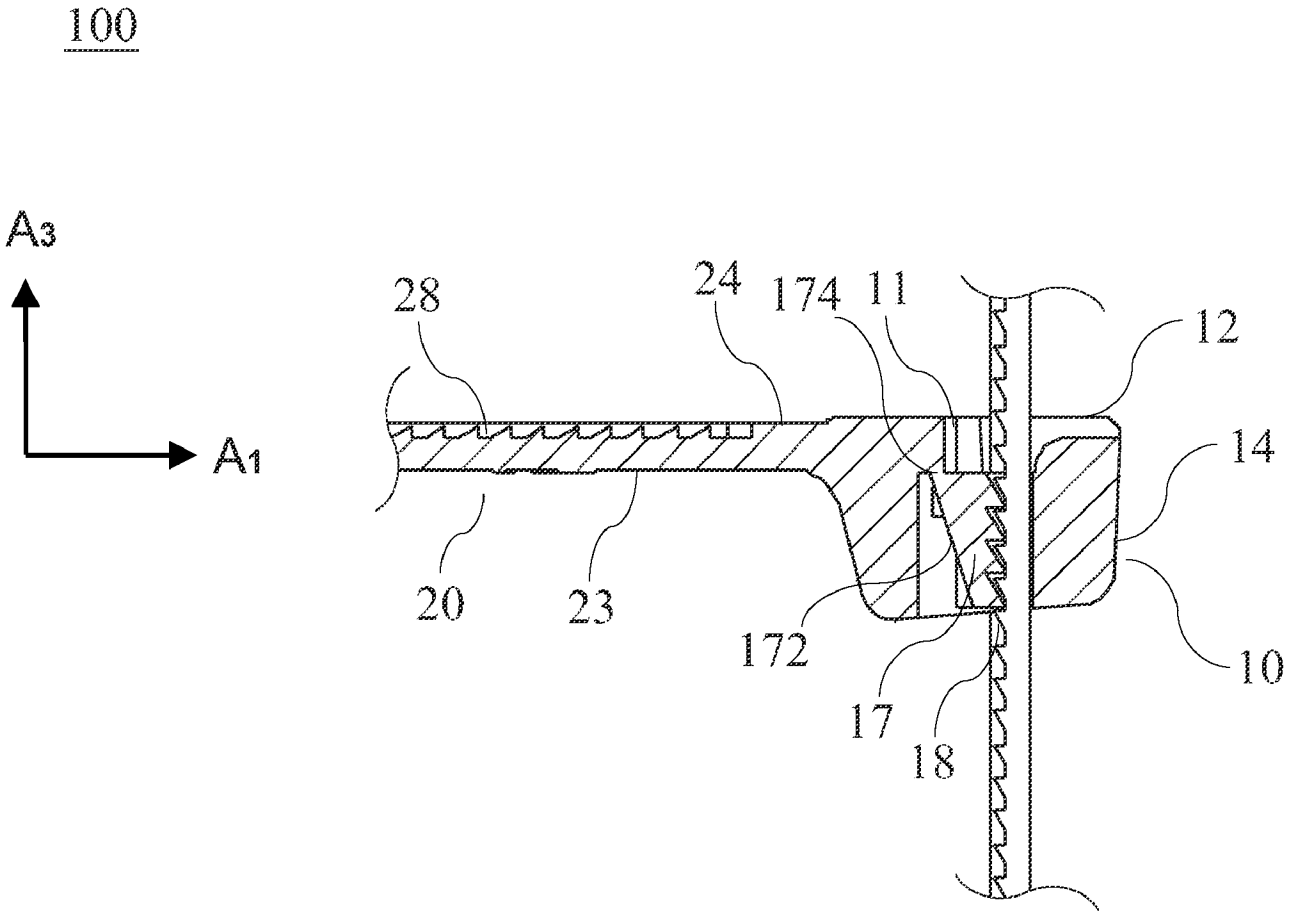
FIG. 4 is a partial sectional view of the improved cable tie structure according to the preferred embodiment of the present invention.
Figure 5:
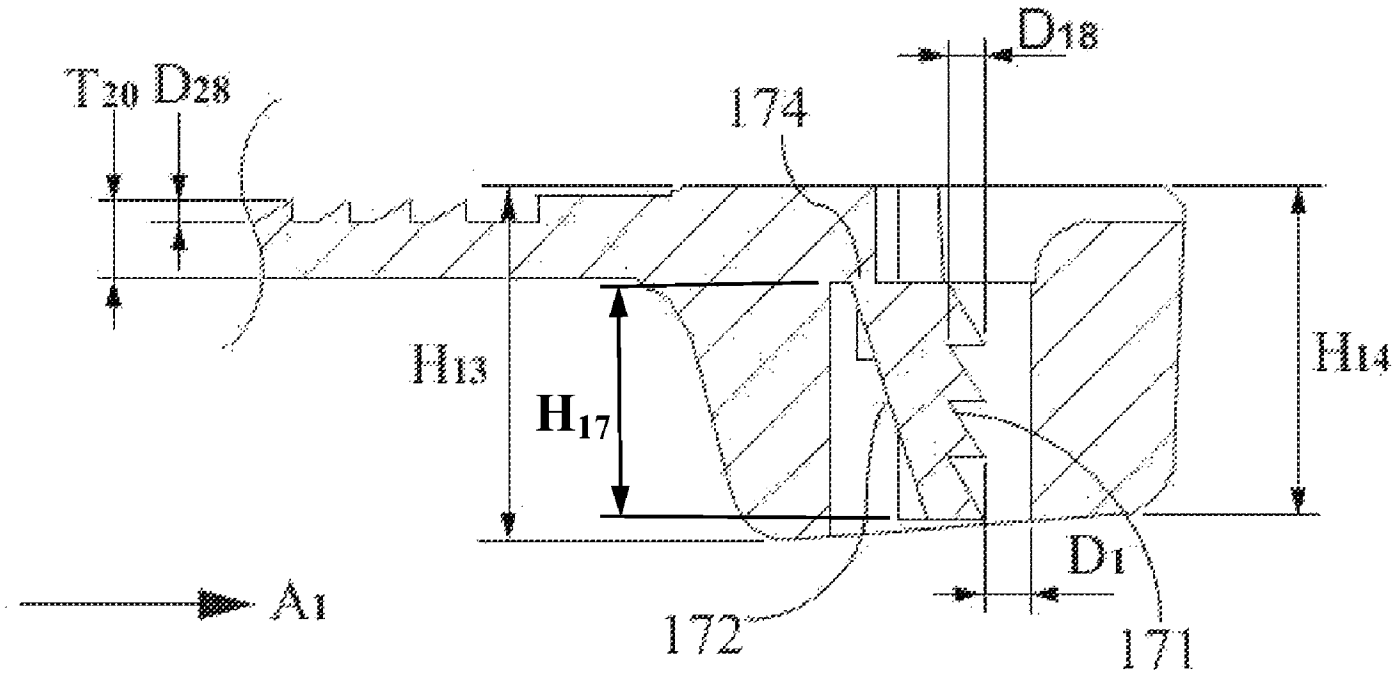
FIG. 5 is another partial sectional view of the improved cable tie structure according to the preferred embodiment of the present invention.

Referring to FIG. 4 and FIG. 5 for sectional views wherein the strap body 20 pierces through the window 11 of the locking head 10 along the third direction A3. The tooth unit 17 of the locking head 10 has a base 174, on which the tooth unit 17 is attached to the base plate 12. The tooth unit 17 extends from the base plate 12 in the window 11 and, when receiving force, is allowed to swing to and fro along the first direction A1 against the base 174. The tooth unit 17 has its one surface facing the second side wall 14 defined as a first surface 171 and another surface away from the second side wall 14 defined as a second surface 172. The first surface 171 is formed with a plurality of first engaging teeth 18. In addition, the strap body 20 has a top surface 23 and a bottom surface 24. The bottom surface 24 of the strap body 20 is formed with a plurality of second engaging teeth 28. Thereby, after the strap body 20 pierces through the window 11 of the locking head 10 along the third direction A3, the plural second engaging teeth 28 of the strap body 20 engage with the plural first engaging teeth 18 of the tooth unit 17, so that the strap body 20 and the locking head 10 are fixed to each other for binding an article to be tied up. It is to be noted that, for achieving firmer engagement between the second engaging teeth 28 of the strap body 20 and the first engaging teeth 18 of the tooth unit 17, the strap body 20 preferably has its thickness T20 greater than a distance D1 between top of the first engaging teeth 18 of the tooth unit 17 and the second side wall 14.

In the prior art, for preventing the strap body 20 from being withdrawn in a direction counter to the third direction A3, it would be necessary to reinforce the tooth unit 17 in its pull-out resistance. For this purpose, a general approach is to increase the sectional area of the base 174 of the tooth unit 17. However, increasing the sectional area of the base 174 could compromise the resilience of the tooth unit 17, leading to hard swing of the tooth unit 17 along the first direction A1. Consequently, when binding an article to be tied up, the strap body 20 would have to be drawn with increased force.

Referring to FIG. 2 through FIG. 5, the present invention, with the attempt to remain the base 174 of the tooth unit 17 tough enough from breakage without increasing the sectional area of the base 174 on which the base 174 is attached to the base plate 12, proposes the improved cable tie structure 100 that further comprises a pair of first protrusions 15 and a pair of second protrusions 16. Each said first protrusion 15 is provided on a respective said first side wall 13 facing the window 11. The tooth unit 17 extends outward from the base plate 12 in the window 11 and between the pair of first protrusions 15. The second protrusions 16 extend respectively from two lateral sides of the tooth unit 17 toward the window 11, and a predetermined slit L (as shown in FIG. 2) extending along the first direction A1 is formed between each facing pair of the second protrusion 16 and the first protrusion 15. Still referring to FIG. 5, preferably, the predetermined slit L is smaller than the depth D28 of the second engaging teeth 28 and the length of the second protrusions 16 in the third direction A3 is smaller than the length of the first protrusions 15 in the same direction. More preferably, the predetermined slit L is smaller than the depth D18 of the first engaging teeth 28.

Thereby, in operation of using the improved cable tie structure 100 of the present invention to bind an article to be tied up (not shown), the strap body 20 pierces through the locking head 10 along the third direction A3, so the second engaging teeth 28 of the strap body 20 push the first engaging teeth 18 of the tooth unit 17 in a direction counter to the first direction A1, such that the tooth unit 17 swings toward the rear end 122 of the base plate 12 against its base 174. At this time, since the depth D18 of the first engaging teeth 18 is greater than the depth D28 of the second engaging teeth 28, a relatively large interval exists between the strap body 20 and the tooth unit 17, as compared with the prior art, so the strap body 20 is allows to enter the window 11 easily with reduced resistance.

After the strap body 20 is adjusted in length to properly bind an article to be tied up, since the second engaging teeth 28 of the strap body 20 engage with the first engaging teeth 18 of the tooth unit 17, withdrawing the strap body 20 from the locking head 10 counter to the third direction A3 can cause the strap body 20 to drive the tooth unit 17 along the first direction A1. Moreover, in virtue of the predetermined slit L formed between each facing pair of the second protrusion 16 and the first protrusion 15 along the first direction A1 (as shown in FIG. 2), the tooth unit 17 is allowed to slightly swing in the first direction A1. Such slight swing in turn makes the first engaging teeth 18 of the tooth unit 17 engage more closely with the second engaging teeth 28 of the strap body 20. Eventually, the second protrusions 16 abut firmly against the first protrusions 15 at the first side walls 13, so that the tooth unit 17 is retained from swinging. Meantime, the first engaging teeth 18 snap the second engaging teeth 28 tightly, so the strap body 20 is secured from being separated from the locking head 10, thereby increasing the anti-loosing pull-out resistance of the cable tie. Furthermore, as a result of that the second protrusions 16 abut against the first protrusions 15 of the first side walls 13, the stress acting on the base 174 of the tooth unit 17 can be reduced, so the base 174 of the tooth unit 17 is unlikely to break.

By comparison, in the prior-art device that lacks for the first protrusions 15 and the second protrusions 16 of the present invention, when the strap body is force to disengage, the entire tooth unit is moved by the strap body. Since the tooth unit is attached to the base plate via the base only, the base receives considerable stress and the tooth unit tends to break at the base. Differently, in the improved cable tie structure 100 of the present invention, the second protrusions 16 firmly abut against the first protrusions 15, so the pulling force from the strap body 20 acting on the tooth unit 17 is partially transferred to the first protrusions 15 of the locking head 10 by the second protrusions 16. As a result, the stress on the base 174 is reduced and thus the base 174 is not fragile, so the tooth unit 17 as a whole is able to bear relatively large pulling force and the strength thereof is improved.

Referring to FIG. 5 together with FIG. 4, for better operability and appearance of the locking head 10 of the improved cable tie structure 100, the height H17 of the tooth unit 17 of the locking head 10 is preferably greater than neither the height H14 of the second side wall 14 nor the height H13 of the first side walls 13. In addition, the second surface 172 of the tooth unit 17 may be formed as an inclined surface that facilitates mold making and mass manufacturing.

Furthermore, referring back to FIG. 3, a guiding surface 141 may be provided on the second side wall 14 of the locking head 10 to face the window 11, for guiding the strap body 20 to be inserted into the window 11. The guiding surface 141 is preferably a cambered surface while also working when it is made as an inclined surface. Thereby, a user can easily make the strap body 20 pierce through the window 11 of the locking head 10 along the third direction A3, so as to tie up an article to be bound readily.

The present invention has been described with reference to the preferred embodiment and it is understood that the embodiment is not intended to limit the scope of the present invention. Moreover, as the contents disclosed herein should be readily understood and can be implemented by a person skilled in the art, all equivalent changes or modifications which do not depart from the concept of the present invention should be encompassed by the appended claims.

What is claimed is:

1. An improved cable tie structure (100), comprising a strap body (20) and a locking head (10), in the improved cable tie structure (100), a first direction (A1) going from the strap body (20) toward the locking head (10) and a second direction (A2) being perpendicular to the first direction (A1), the locking head (10) having a window (11), a third direction (A3) going upward from the window (11) and being perpendicular to both the first direction (A1) and the second direction (A2), the strap body (20) having a first end (21) and a second end (22) opposite to each other in the first direction (A1), the first end (21) being attached to the locking head (10), and the second end (22) being configured to pierce through the window (11) and then engage with the locking head (10), the improved cable tie structure (100) being characterized in:

the locking head (10) having a base plate (12), a pair of first side walls (13), a second side wall (14), a pair of first protrusions (15), a pair of second protrusions (16) and a tooth unit (17), the window (11) being formed on the base plate (12), the base plate (12) having a front end (121) and a rear end (122) opposite to each other in the first direction (A1), the first side walls (13) defining two opposite borders of the window (11) in the second direction (A2), the second side wall (14) defining a border of the window (11) in the first direction (A1), the second side wall (14) having two lateral sides (142) thereof attached to the first side walls (13), respectively, each said first protrusions (15) being provided at a respective said first side wall (13) and facing the window (11), the tooth unit (17) having a base (174) attached to the base plate (12), the tooth unit (17) extending from the base plate (12) in the window (11) and being located between and distant from the first protrusions (15), the tooth unit (17) having a first surface (171) that faces the second side wall (14) and a second surface (172) that is away from the second side wall (14), the first surface (171) having a plurality of first engaging teeth (18), the pair of second protrusions (16) respectively extending toward the window (11) along the second direction (A2) from two lateral sides of the tooth unit (17) with the lateral sides of the tooth unit (17) being between the base (174) and the first surface (171), the second protrusions (16) having a length smaller than a length of the first protrusions (15), and a predetermined slit (L) extending along the first direction (A1) exists between each facing pair of the second protrusion (16) and the first protrusion (15) to allow the tooth unit (17) to slightly swing in the first direction (A1); and the strap body (20) having a top surface (23) and a bottom surface (24), the bottom surface (24) being provided with a plurality of second engaging teeth (28) for engaging the first engaging teeth (18) of the tooth unit (17), the second engaging teeth (28) having a depth (D28) smaller than a depth (D18) of the first engaging teeth (18), and the strap body (20) having a thickness (T20) greater than a distance (D1) between a top of one said first engaging teeth (18) of the tooth unit (17) and the second side wall (14).

2. The improved cable tie structure (100) of claim 1, wherein the predetermined slit (L) is smaller than the depth (D28) of the second engaging teeth (28).

3. The improved cable tie structure (100) of claim 1, wherein the predetermined slit (L) is smaller than the depth (D18) of the first engaging teeth (18).

4. The improved cable tie structure (100) of claim 1, wherein the tooth unit (17) has a height (H17) not greater than a height (H14) of the second side wall (14).

5. The improved cable tie structure (100) of claim 1, wherein the tooth unit (17) has a height (H17) not greater than a height (H13) of the first side walls (13).

6. The improved cable tie structure (100) of claim 1, wherein the second surface (172) of the tooth unit (17) is formed as an inclined surface.

7. The improved cable tie structure (100) of claim 1, wherein the second side wall (14) is provided with a guiding surface (141) facing the window (11).

8. The improved cable tie structure (100) of claim 7, wherein the guiding surface (141) is a cambered surface.

* * * * *